United States Patent [19]

Fuderer

[11] 4,350,583

[45] Sep. 21, 1982

[54] ISOBARIC PROCESS FOR SEPARATING NORMAL PARAFFINS FROM HYDROCARBON MIXTURES

[75] Inventor: Andrija Fuderer, Antwerp, Belgium

[73] Assignee: Union Carbide Corporation, Danbury, Conn.

[21] Appl. No.: 189,352

[22] Filed: Sep. 30, 1980

[51] Int. Cl.[3] ..... C10G 25/03

[52] U.S. Cl. ..... 208/310 Z; 585/821; 585/826

[58] Field of Search ..... 208/310 Z; 585/826, 585/829, 821

[56] References Cited

U.S. PATENT DOCUMENTS

| | | | |
|---|---|---|---|
| 3,282,346 | 11/1966 | Anstey et al. | 208/310 |
| 3,291,725 | 12/1966 | Brodbeck | 208/310 |
| 3,342,726 | 9/1967 | Mowll et al. | 208/310 |
| 3,422,005 | 1/1969 | Avery | 208/310 |
| 4,176,053 | 11/1979 | Holcombe | 208/310 Z |

*Primary Examiner*—Delbert E. Gantz
*Assistant Examiner*—William Leader
*Attorney, Agent, or Firm*—Alvin H. Fritschler

[57] ABSTRACT

Normal paraffins are separated from a gas oil-containing hydrocarbon vapor feed stream having 16 to 25 carbon atoms per molecule in a constant pressure process employing a molecular sieve adsorbent and n-hexane for purging and for dilution of gas oil-containing feedstocks. Countercurrent purge effluent is used to provide a source of such n-hexane diluent, thereby effecting a savings in the amount of energy necessary to process the purge recycle stream and the size of the equipment used therefor.

7 Claims, 1 Drawing Figure

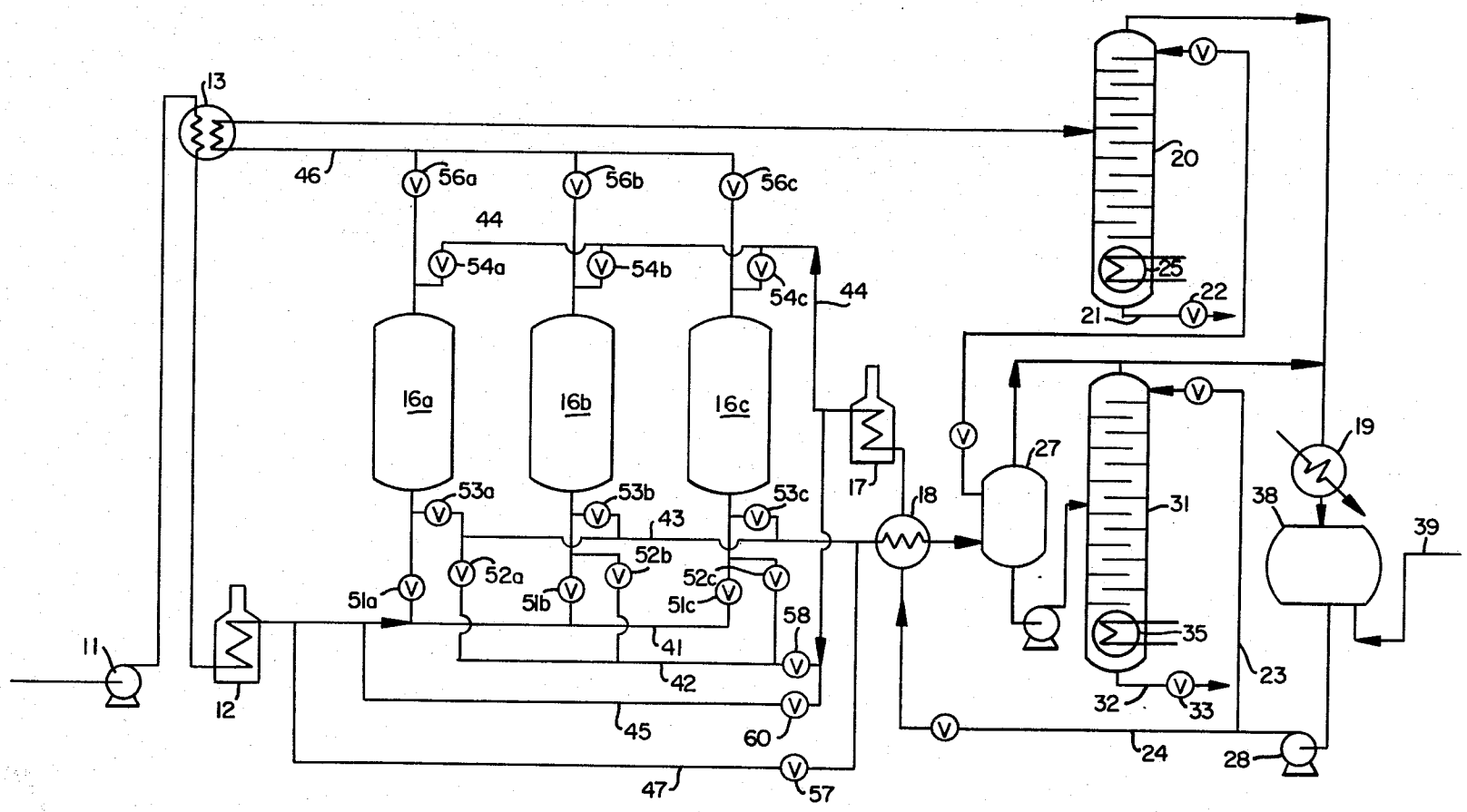
39
19
38
23
28
20
22
25
21
31
35
33
32
24
27
18
17
44
56c
54c
53c
58
60
57
16c
52c
51c
41
42
43
56b
54b
53b
52b
45
47
16b
51b
44
56a
54a
53a
52a
16a
51a
46
13
12
11

ISOBARIC PROCESS FOR SEPARATING NORMAL PARAFFINS FROM HYDROCARBON MIXTURES

BACKGROUND OF THE INVENTION

1. Field of the Invention

This invention relates to the separation of normal paraffins from hydrocarbon mixtures thereof with non-normal hydrocarbons. More particularly, it relates to the separation of said normal paraffins from gas oil-containing feedstocks.

2. Description of the Prior Art

An isobaric process for the separation of normal paraffins from a hydrocarbon vapor feed stream having 10–25 carbon atoms per molecule and containing a mixture of said normal paraffins and non-normal hydrocarbons is disclosed in the Avery U.S. Pat. No. 3,422,005. The feedstock may contain gas oil having 16 to 25 carbon atoms, kerosene having 10 to 15 carbon atoms, or a mixture thereof. The patent discloses the steps of (1) adsorption, i.e. selective adsorption of normal paraffins, (2) cocurrent purge with n-hexane to sweep out void space vapor containing a high concentration of non-adsorbable components, i.e. non-normal hydrocarbons, from the upper of effluent end of the bed, (3) countercurrent purge with n-hexane to desorb normal hydrocarbon adsorbate from the bed, the highest molecular weight, adsorbed normal hydrocarbons i.e., paraffins, being concentrated near the bottom or feed end of the bed. The effluent from the upper end of the bed is cooled and passed to a non-normal dehexanizer column from which non-normal hydrocarbons are withdrawn as a liquid bottoms product. The effluent from the bottom end of the bed is cooled and passed to a normal paraffin dehexanizer column from which normal paraffin bottoms are withdrawn. The n-hexane discharged as overhead from said columns is transferred to storage as liquid and is subsequently heated and used as purge fluid as indicated above. The advantages of employing n-hexane as the purge fluid and of employing a relatively high isobaric adsorption-desorption pressure level, together with a relatively low adsorption-desorption temperature range, are set forth in the Avery patent.

It has been found that the separation process should be carried out a temperature above the dew point of the hydrocarbon feed and sufficiently high to avoid capillary condensation. Operating at such a temperature serves to avoid capillary condensation and the formation of a liquid meniscus in the macropores of pellets. If such a precaution were not taken, the isomer condensate in the adsorbent macropores would not be completely removed during the copurge or displacement step, and the normal paraffin purity as well as the separation of adsorbed and unadsorbed components would be lower than in an all-vapor process. It is possible to avoid capillary condensation by ensuring that the ratio of feed saturation pressure (i.e. dew point pressure) to operating pressure is more than about 2. For this purpose, a gas oil feedstock having, for example, a dew point of 670° F. at a typical operating pressure of 25 p.s.i.a. should be contacted with a molecular sieve adsorbent at a temperature of about 730° F. At such a temperature, however, excessive cracking of the gas oil vapor feed occurs, with coke formation and rapid deactivation of the coke resulting therefrom. For this reason, it is preferred to operate at temperatures of between about 600° and 700° F. with gas oil feedstocks. In this regard, it should be noted that the cracking and deactivation rates increase with increasing molecular weights, and the problems are less serious with respect to the lighter kerosene feedstocks. A particular problem exists, therefore, in the processing of gas oil feedstocks so as to operate at a temperature sufficiently high to avoid capillary condensation without encountering significant cracking and deactivation problems.

Avery discloses the overcoming of this problem by the introduction of sufficient redistilled n-hexane purge into the gas oil-containing feed to lower the resulting mixture's dew point and to avoid capillary condensation at the desired operating pressure so as to permit operation at a temperature below 700° F. As the adsorbent already contains normal hexane from the previous purge step, the n-hexane introduced into the feed for dilution thereof is discharged from the bed with the unadsorbed non-normal hydrocarbons and the previously adsorbed n-hexane. This effluent is fractionated as indicated above, with the n-hexane overhead fraction being recycled for use as purge gas or for mixing with the feed material.

It has also been proposed to recycle the adsorption effluent, i.e. non-normal hydrocarbon product, to the feedstock for the desired dilution thereof. While such techniques are useful in overcoming capillary condensation while enabling temperature below 700° F. to be employed, each is accompanied by disadvantages that limit the overall economy and effectiveness of the separation process. Thus, the use of redistilled n-hexane for feedstock dilution increases the size of the equipment employed and the amount of energy consumed in the processing of the n-hexane recycle stream, thereby increasing the cost of the overall operation. The use of the adsorption effluent for such dilution purposes tends to increase the amount of non-normals in the feed and also the amount of normal paraffins present in the product effluent, reducing the normals as well as the non-normal hydrocarbon product purity and the separate recovery of n-paraffin material. There is a need in the art, therefore, for improvements in the process for separating normal paraffins from hydrocarbon mixtures, particularly as exist in gas oil feedstocks.

It is an object of the invention to provide an improved process for the separation of normal paraffins from hydrocarbon feedstocks.

It is another object of the invention to provide an improved process for the separation of normal paraffins from gas oil feedstocks without capillary condensation effects.

It is a further object of the invention to provide a process for the effective separation of normal paraffins from gas oil feedstocks at temperatures below 700° F.

With these and other objects in mind, the invention is hereinafter described in detail, the novel features thereof being particularly pointed out in the appended claims.

SUMMARY OF THE INVENTION

The objects of the invention are accomplished by an isobaric separation process in which countercurrent purge effluent is used to provide a source of n-hexane diluent for the gas oil-containing feed. A sufficient quantity of such n-hexane diluent is employed to lower the dew point of the mixture of the diluent and the feed and to avoid capillary condensation at the desired operating pressure. The separation of normal paraffins from the gas oil feed can thus be accomplished at below 700° F.

BRIEF DESCRIPTION OF THE DRAWING

The invention is hereinafter described with reference to the accompanying single FIGURE drawing representing a schematic flowsheet for an illustrative embodiment of the invention utilizing three adsorbent beds operating in parallel.

DETAILED DESCRIPTION OF THE INVENTION

The subject invention constitutes an improved process for the separation of normal paraffins from hydrocarbon vapor mixtures present in gas oil-containing feedstocks. Gas Oil may be broadly defined, for purposes of this invention, as a hydrocarbon mixture having an initial boiling point, according to the ASTM, of above 400° F. and an ASTM final boiling point below 700° F. Gas oil generally contains from about 10 to about 40 mol percent normal paraffins having 16 to 25 carbon atoms. These normal paraffins are employed as raw materials for the synthesis of proteins, plasticizers, and alcohols. It is necessary, however, to separate such normal paraffins from non-normal hydrocarbons contained in the gas oil feed material.

As noted above, the Avery patent discloses an isobaric or constant pressure process for achieving this separation, comprising: (1) adsorbing the normal paraffins on an adsorbent, (2) concurrently purging the adsorbent bed with n-hexane to remove non-normal hydrocarbons, and (3) countercurrently purging the bed with n-hexane to desorb the normal paraffins. Additional n-hexane is employed to dilute the gas oil feed to lower the dew point of the feed mixture and to avoid capillary condensation to that the process can be carried out at less than 700° F. to avoid excessive cracking of the gas oil vapor feedstock, with resultant coke formation and rapid deactivation of the adsorbent.

The invention resides in the use of countercurrent purge effluent as a source of the n-hexane diluent. Such countercurrent purge effluent is used in place of n-hexane obtained by redistillation of the cocurrent purge effluent and of the countercurrent purge effluent or of the adsorption effluent. The size of the equipment and the amount of energy consumed for the redistillation, pumping and heating up of the n-hexane purge recycle stream is thereby reduced.

Referring to the drawing, the gas oil-containing feedstock enters the illustrated process system through pump 11 at, e.g. 65 p.s.i.a, said feed being heated, e.g. to 600° F., in exchange 13 and heater 12 from which it is passed through conduit 41 and inlet control valve 51*a* to first molecular sieve adsorbent bed 16*a*. The bed may typically contain calcium zeolite A in the form of 1/16 inch pellets. The feed vapor mixture is passed upwardly through said molecular sieve bed 16*a* at about 30 p.s.i.a. for adsorption of the normal paraffins therefrom. During the adsorption step, normal paraffins are selectively adsorbed, and a normal paraffin adsorption front is formed near the inlet end of bed 16*a*. As adsorption continues, this front moves upwardly from the inlet end, displacing less strongly held n-hexane purge component adsorbed in the previous processing cycle. A portion of the non-normal hydrocarbons not adsorbed from the feed upon passage through the bed, i.e. cyclic and branch chain hydrocarbons, are discharged through the upper end of bed 16*a* into conduit 46 as the first effluent. This effluent also contains the progressively displaced, re-adsorbed and re-displaced n-hexane purge component and any n-hexane used as diluent for the hydrocarbon feed. After a predetermined time that is preferably when the leading adsorption front has reached a predetermined point within bed 16*a*, as for example after about 5 minutes, the gas oil-containing hydrocarbon feed stream flow is terminated by closing inlet valve 51*a*.

The first effluent from bed 16*a*, containing about 20% n-hexane, is passed through control valve 56*a* to conduit 46 and through heat exchanger 13. To facilitate fractional condensation, the first effluent is cooled to about 380° F. therein by a coolant, such as the hydrocarbon feed, flowing through said exchanger. The cooled first effluent is directed to non-straights dehexanizer column 20 at about 35 p.s.i.a. In this column, the non-normal hydrocarbons are separated and withdrawn as a liquid bottoms product through conduit 21 having control valve 22 therein. Dehexanizer 20 comprises a distillation column with a sufficient number of theoretical plates so that n-hexane appears in the overhead, and the bottoms are free of n-hexane as needed to meet a particular non-normal hydrocarbon product specification. Dehexanizer 20 also includes reboiler 25 in the bottom. The overhead vapor is condensed in air-cooled or water-cooled condenser 19, and the n-hexane is collected in storage vessel 38, from which the n-hexane is pumped and used partly through line 23 to the dehexanizer as reflux and partly through conduit 24 to heat exchanger 18 and heater 17 to be used as desorption purge vapor.

Upon completion of the adsorption step, n-hexane purge vapor is introduced from recycle conduit 44 into conduit 42, control valves 58 and 52*a* therein and into the bottom end of adsorption bed 16*a* for upward flow therethrough in the same direction, i.e. cocurrent, with the previously flowing hydrocarbon feed vapor. This cocurrently flowing purge vapor is capable of being internally adsorbed, and effectively removes the non-internally sorbed molecules, i.e. the non-normal hydrocarbons, remaining in the bed, together with residual feed vapor remaining in the non-selective areas of the bed after adsorption. The cocurrently flowing n-hexane purge vapor is passed through first adsorption bed 16*a* essentially at the adsorption step temperature and pressure. Such cocurrent flow is necessary to sweep out the void space vapor that contains the highest concentration of non-adsorbable components at the upper, or effluent, end of the bed.

Upon completion of the cocurrent purge step, n-hexane purge vapor is introduced from said recycle conduit 44, through control valve 54*a* therein, to the upper end of the first adsorbent bed 16*a* at substantially the adsorption step temperature and pressure for countercurrent flow therethrough. This countercurrent purge desorbs the normal paraffin hydrocarbon adsorbate from molecular sieve bed 16*a*. The resulting mixture is discharged from the lower end through conduit 42 having control valve 52*a* therein. Countercurrent purging is used for desorption of the adsorbate because the heaviest, i.e. highest molecular weight, normal hydrocarbons are more concentrated near the feed inlet, lower end of the bed. By employing countercurrent flow, the heaviest paraffin hydrocarbons are subjected to the purging or desorbing, influence of both the purge vapor itself and the lighter paraffin hydrocarbons desorbed from the upper end of the bed.

Apart from its use in the practice of the invention, this second effluent in conduit 42, containing about 80% n-hexane on an overall basis, is cooled by liquid n-hexane in exchanger 18, and is then directed to phase separator vessel 27. Substantially pure n-hexane vapor is recovered therefrom and sent to condenser 19. The remaining normal paraffin-hexane mixture is directed to normals dehexanizer column 31 at about 20 p.s.i.a. The cooling and phase separation steps serve to facilitate separation of the n-hexane and normal paraffins by fractional condensation, and reduce the quantity of n-hexane that must be processed dehexanizer column 31. In this column, the vapor mixture is separated into a normal paraffin bottoms component that is withdrawn through conduit 32 having control valve 33 therein, and a n-hexane overhead component. Said normals dehexanizer column 20, has reboiler 35 at the lower end, and an appropriate number of theoretical plates so that the n-hexane appears in the overhead, and the bottoms are free of n-hexane as needed to meet a particular normal paraffin hydrocarbon product specification.

The n-hexane overhead fraction from normals dehexanizer column 31 is passed also to condenser 19 and therefrom to storage vessel 38, along with the n-hexane overhead from non-normals dehexanizer column 20.

The invention resides in the use of a portion of the countercurrent purge effluent, i.e. the desorption effluent, as a source of n-hexane for the dilution of gas oil-containing hydrocarbon feedstream. For this purpose, a portion of the countercurrent purge effluent is diverted from the countercurrent purge conduit 43, via outlet control valve 57 and conduit 47 into feed inlet conduit 41. For advantageous results, only that portion of the countercurrent purge effluent that contains not more than about 6 weight percent normal paraffins is preferably recycled to the gas oil-containing feed for the dilution purposes of the invention. It will be appreciated that the concentration of normal paraffins in the countercurrent purge, i.e. desorption effluent, changes considerably during the desorption step. Initially, the concentration of normal paraffins increases sharply to a high of about 20–30 weight percent, depending on the characteristics of the feedstock, and then drops rapidly to below said 6 weight percent. Towards the end of the desorption step, said concentration is at about 2–3 weight percent level.

By employing the desorption effluent from the bed as it is completing its desorption step, i.e. when the normal paraffin content is below about 6 weight percent, and generally on the order of about 3–4 weight percent, the desirable effects of the feed dilution operation are obtained without the advantages thereof being fully offset by the need for larger adsorption beds and more n-hexane purge as a result of the additional adsorption of appreciable quantities of normal paraffins from the countercurrent purge used for dilution of the feed. In addition to the desired lowering of the dew point of the feed with resultant suppression of capillary condensation, those skilled in the art will appreciate that the countercurrent purge, i.e. desorption effluent, is already at the desired adsorption pressure and temperature and does not have to be pumped, evaporated and heated to high temperature as when fresh, redistilled n-hexane is employed for feed dilution purposes. Thus, a considerable saving in equipment and fuel costs is achieved in the practice of the invention.

The first portion of the countercurrent purge effluent, containing appreciable quantities of normal hydrocarbons, is preferably passed from first bed **16*a* through conduit 43 for passage to separator vessel 27 as indicated above. Additional quantities of n-hexane diluent may be added to the feed material in conduit 41 from n-hexane recycle conduit 45 and control valve 60. The reflux hexane is pumped to the dehexanizers by pump 28 through line 23**.

Any makeup n-hexane that may be needed for the process may be introduced to storage vessel 38 from an external source through conduit 39. The n-hexane required for purging can be withdrawn from vessel 38 also by pump 28. Such n-hexane is warmed and vaporized in heat exchanger 18, and, in heater 17, it is heated to the adsorption step temperature. The resulting hot n-hexane vapor is then passed through valve 58, conduit 42 and control valve **52*a*, during the appropriate period, as the cocurrently flowing purge vapor entering said first molecular sieve adsorption bed 16*a* immediately following the adsorption step. The hot n-hexane vapor discharged from heater 17 is also directed through conduit 44 and control valve 54*a*, during the appropriate period, for countercurrent purging of first bed 16*a***, thereby desorbing the normal paraffin adsorbate as previously described. Additional n-hexane may also be recycled for feed dilution purposes in addition to the desorption effluent used for such purposes, as required in any particular application.

Although the process has been specifically described in terms of sequential adsorption, cocurrent purge and countercurrent desorption of first chamber **16*a*, it will be apparent to those skilled in the art that second and third chambers 16*b* and 16*c* may also be filled with a molecular sieve adsorbent, e.g. with calcium zeolite pellets, and piped in parallel flow relation with said first chamber 16*a*. Such an arrangement with more than one adsorbent bed is preferred since most commercial operations require continuous production. For this reason, at least three adsorbent beds are usually employed so that, while one bed is on the adsorption step, another bed is being used for copurging and a third bed for the countercurrent desorption step. This permits continuous production of both n-paraffins and non-normal hydrocarbons by means of the three step process. The flows between first, second and third adsorbent chambers are switched at the appropriate times in a manner well known to those skilled in the art. The second and third adsorption beds are provided by conduits and control valves, 52*b*, 52*c*, 54*b*, 54*c*, not numbered, corresponding to those described with reference to first bed 16*a***. In the practice of the invention, the use of four or more beds with two beds simultaneously on desorption is particularly desirable. The desorption effluent for dilution can thus be taken from the bed that is completing its desorption step. For this purpose, each bed would have two desorption valves connected with two different heaters. In this manner, the normal paraffin content of the portion of the desorption effluent used for feed dilution can advantageously be maintained at less than 6 weight percent, e.g. on the order of about 3–4 weight percent, to enhance the advantages of the invention as indicated above.

It will be appeciated that various changes and modifications can be made in the process described above without departing from the scope of the invention claimed herein. Thus, the adsorption-purge-desorption steps can be carried out at temperatures of from about 500° F. to 700° F., preferably at a temperature within the range of from about 600° F. to said 700° F. As disclosed by the Avery patent, the purge and desorption step temperatures and pressures are desirably the same as those employed in the adsorption step. Such processing steps are carried out in an essentially constant pressure process, employing a relatively high, superatmospheric pressure in the range of from about 15 to about 65 p.s.i.a. It should also be noted that the gas oil-containing feedstocks treated in accordance with the present invention may also include mixtures of such gas oil with kerosene. Such kerosene may be broadly defined as a hydrocarbon mixture having an initial boiling point, according to the American Society of Testing Materials (ASTM) of about 275° F. and an ASTM final boiling point below 600° F. Kerosene contains between about 10 and 40 mol percent normal paraffins having 10 to 15 carbon atoms per molecule.

Various other aspects of the subject adsorption-purge-desorption process for separating normal paraffins from hydrocarbon mixtures are described in the Avery patent referred to above and incorporated herein by reference. Such aspects, including the molecular sieve adsorbents suitable for use in the process and information concerning the relation between dew point and capillary condensation points for a particular gas oil various operating pressure, and the means for determining the percentage dilution of the gas oil feed with normal hexane and other diluents, need not be repeated herein. In the practice of the invention, of course, the gas oil-containing feed is diluted with countercurrent purge effluent, as a source of n-hexane, to permit operation of the process at a temperature below 700° F.

In preferred embodiments, only the portion of said effluent that contains less than about 6 weight percent normal paraffins is used as diluent for the gas oil-containing feed stream. The initial portion of the countercurrent purge effluent that contains greater amounts of normal paraffins is preferably treated as indicated above with respect to the use of said purge effluent apart from the dilution purposes of the invention.

In an illustrative example of the practice of the invention, a gas oil feed having an average molecular weight of 210, with a weight fraction of 0.3 normal paraffins, is processed at 640° F. and a pressure of 30 p.s.i.a. in a three adsorption bed system as shown in the drawing. A low operating temperature, requiring the relatively high dilution of 26 weight percent of the overall diluted feed, is employed as it results in only a moderate deactivation rate for the calcium zeolite A adsorbent, despite the high sulfur content of the feed. As each bed passes through the adsorption, copurge and desorption cycle, the desorption effluent, i.e. the countercurrent purge, contains an average 8–12 weight percent normal paraffins. The initial desorption effluent from each bed is passed to phase separator 27 for processing as disclosed above with reference to the system as shown in the drawing. When each bed is completing the desorption step of each cycle, the desorption effluent containing less than about 6 weight percent paraffins is diverted as a source of n-hexane for mixture with the gas oil-containing feed. The normal paraffin content of the desorption effluent decreases during the time in which said effluent is used for dilution purposes, averaging about 3–4 weight percent. The n-hexane in the desorption effluent is effective as a source of n-hexane to replace like amounts of redistilled n-hexane in achieving the desired dilution of the feed. While the dew point is reduced by either method so as to avoid capillary condensation, the use of redistilled hexane for dilution required that the desired quantity of n-hexane be pumped, evaporated, heated up to above 600° F. and cooled down and recovered for recycle, all of which involves considerable additional equipment and fuel costs. The desorption effluent, however is already at the desired operating pressure and temperature. It does not need to be pumped, evaporated and heated, so that its use in the practice of the invention results in a significant reduction in the equipment size and energy consumption required for the processing of the n-hexane recycle stream employed for purging and dilution purposes. Thus, the invention enables improved processing and reduced costs to be achieved, providing and advantageous improvement over the previously known use of redistilled n-hexane for dilution of the gas oil-containing feed to avoid capillary condensation effects at temperatures below 700° F.

Those skilled in the art will readily appreciate that any desired temperature in the indicated ranges up to 700° F. can be used in the subject isobaric adsorption-copurge-desorption process for normal paraffin recovery from gas oil feeds. Such temperature will determine the amount of dilution employed at a desired operating pressure. From such factors and the desired purity of the product, feed stream characteristics, adsorbent performance capability and the like, those skilled in the art can readily determine the amount of desorption effluent, and additional recycle n-hexane, to be employed in any given application.

As discussed above, the invention has the advantage of reducing the size of the equipment and the energy consumption associated with the processing of n-hexane recycle stream as compared to the practice as disclosed by the Avery patent in which redistilled n-hexane is employed not only for copurge and countercurrent desorption purposes, but for dilution of the gas oil-containing feedstocks as well. It should be noted that the recycle of desorption effluent for feed dilution can also be employed with kerosene feed streams although such recycle does not offer the desirable advantages that pertain for gas oil feed streams. The advantage of lower process temperature is largely compensated by the dilution of feed with hexane.

The invention provides a valuable improvement in the constant pressure process for separating normal paraffins from hydrocarbon mixtures. The invention enables gas oil-containing feedstocks to be treated for said separation of normal paraffins at temperatures below 700° F., thus avoiding capillary condensation, while achieving significant improvements in the process. The use of desorption effluent for feed dilution provides the overall advantages in terms of cost, equipment and performance on a manner accommodating the needs of particular normal paraffin separation applications. The overall technical-economic feasibility of the separation process is enhanced by the practice of the invention, particularly in the treatment of gas oil-containing feedstocks.

What is claimed is:

1. In an isobaric process for separating normal paraffins from non-normal hydrocarbons in a gas oil-containing vapor feed stream by (1) the selective adsorption of normal paraffins by passage of said feed stream through a molecular sieve adsorbent bed, (2) cocurrent purge with n-hexane to sweep out void space vapor containing a high concentration of non-normal hydrocarbons from the effluent end of the bed, (3) countercurrent purge with n-hexane to desorb normal paraffin adsorbate from the bed, (4) recovery of n-hexane from said separated normal paraffins and non-normal hydrocarbons, and (5) recycling of said n-hexane for purging and desorbing of said bed and to dilute the gas oil-containing feed stream for adsorption at less than 700° F., the improvement comprising diluting said gas oil-containing feed stream with the final portion of the total countercurrent purge effluent obtained in desorption step (3) as a source of n-hexane used to enable processing of said feed stream to be separated at less than 700° F. without capillary condensation effects, said final portion comprising countercurrent purge effluent containing less than about 6 weight percent normal paraffins other than n-hexane desorbent, whereby the equipment size and energy consumption for processing of said recycle n-hexane are reduced.

2. The process of claim 1 in which said effluent used for dilution purposes contains normal paraffins averaging from 3 to about 4 weight percent of said effluent.

3. The process of claim 1 in which said isobaric pressure is in the range of from about 15 to about 65 p.s.i.a., said adsorption being carried out at a temperature of from about 500° to 700° F., said cocurrent purge and said countercurrent purge being carried out at the adsorption temperature.

4. The process of claim 3 in which said adsorption temperature is from about 600° to 700° F.

5. The process of claim 3 in which said feed stream is treated in at least two molecular sieve adsorbent beds, with said feed stream being introduced into at least one bed continuously so that intermittent production is avoided.

6. The process of claim 5 in which said feedstock is treated in three beds, with one bed undergoing adsorption while the second bed is undergoing cocurrent purge and the third bed is undergoing countercurrent purge.

7. The process of claim 1 in which said gas oil-containing feed stream comprises a mixture of gas oil and kerosene.

* * * * *